US007942481B2

(12) United States Patent
Leppänen

(10) Patent No.: US 7,942,481 B2
(45) Date of Patent: May 17, 2011

(54) ROCK DRILL AND METHOD OF BREAKING ROCK

(75) Inventor: Jarmo Leppänen, Gauteng (ZA)

(73) Assignee: Sandvik Mining and Construction OY, Tampere (FI)

( * ) Notice: Subject to any disclaimer, the term of this patent is extended or adjusted under 35 U.S.C. 154(b) by 577 days.

(21) Appl. No.: 11/886,070

(22) PCT Filed: Mar. 13, 2006

(86) PCT No.: PCT/ZA2006/000037
§ 371 (c)(1),
(2), (4) Date: May 21, 2008

(87) PCT Pub. No.: WO2006/099637
PCT Pub. Date: Sep. 21, 2006

(65) Prior Publication Data

US 2008/0236433 A1 Oct. 2, 2008

(30) Foreign Application Priority Data

Mar. 14, 2005 (ZA) ..... 05/2142

(51) Int. Cl.
*E21C 37/12* (2006.01)
*E21B 7/00* (2006.01)

(52) U.S. Cl. ..... 299/13; 175/4.57

(58) Field of Classification Search ..... 299/13, 299/14; 175/2, 3.5, 4.57
See application file for complete search history.

(56) References Cited

U.S. PATENT DOCUMENTS

| | | | | | |
|---|---|---|---|---|---|
| 1,585,664 | A | * | 5/1926 | Gilman | 299/13 |
| 3,190,372 | A | * | 6/1965 | Johnson | 175/4.5 |
| 4,419,935 | A | * | 12/1983 | Shibukawa | 299/13 |
| 4,508,035 | A | * | 4/1985 | Mashimo et al. | 299/13 |
| 5,098,163 | A | | 3/1992 | Young, III | |
| 5,803,551 | A | * | 9/1998 | McCarthy | 299/13 |
| 6,000,479 | A | * | 12/1999 | Ambs | 175/4.57 |

FOREIGN PATENT DOCUMENTS

EP 1 338 758 8/2003

* cited by examiner

*Primary Examiner* — John Kreck
(74) *Attorney, Agent, or Firm* — Drinker Biddle & Reath LLP

(57) ABSTRACT

A method of breaking rock which includes the steps of drilling a hole in the rock using a drill rod; leaving the drill rod in the hole; using water flow to direct a propellant charge into the hole through a passage in the drill rod; and at a leading end of the drill rod, firing the propellant charge with, at least, the drill rod and water in the hole and passage providing a stemming function.

11 Claims, 5 Drawing Sheets

ROCK DRILL AND METHOD OF BREAKING ROCK

CROSS REFERENCE TO RELATED APPLICATIONS

This application is the National Stage of International Application No. PCT/ZA2006/000037 filed Mar. 13, 2006, and claims benefit of South African Application No. 2005/02142 filed Mar. 14, 2005, both of which are herein incorporated by reference in their entirety.

BACKGROUND OF THE INVENTION

This invention relates generally to the breaking of rock. More particularly the invention is concerned with a rock breaking system which can be implemented substantially on a continuous basis.

SUMMARY OF INVENTION

The invention provides, in the first instance, a method of breaking rock which includes the steps of drilling a hole in the rock, directing a propellant charge into the hole, introducing a stemming medium into the hole, and firing the propellant charge.

The propellant charge may be directed into the hole through a pipe. Preferably the hole is drilled with a drill rod and the propellant charge is directed into the hole through a passage in the drill rod.

The method may include the step of pumping water into the hole thereby to provide the stemming medium. The water may be introduced into the hole before or after the propellant charge, or substantially together with the propellant charge. Additionally however the pipe and the drill rod, if used, also contribute to the stemming effect.

The propellant charge may be directed into the hole using any appropriate medium but preferably is directed into the hole using water under pressure.

The propellant charge may be fired by accelerating the propellant charge into the hole using any suitable mechanism. Preferably however the propellant charge is accelerated into the hole using high pressure water.

The propellant charge may be fired by firing means inside the hole or the drill rod. Preferably the firing means is constituted by a firing device inside the drill rod or on a drill bit attached to the drill rod.

The propellant charge may be fired (ignited) while it is inside the drill rod, at a leading end thereof, or it may be fired when it is outside the drill rod for example at a location which is between opposing surfaces of a blind end of the hole which is drilled and an opposing leading surface of a drill bit. Firing in the latter instance may be achieved by initiating a pressure sensitive primer.

Another possibility is to fire the charge by ejecting it from the drill rod, at a sufficiently high speed, so that a leading end of the cartridge, which carries a primer and, optionally, a small impact transferring member which is in contact with the primer, impacts a rock surface opposing a discharge end of the drill rod i.e. the blind end of the hole. This arrangement causes the cartridge to be fired outside the drill rod.

It is preferred however to fire the propellant charge substantially at a junction between the drill rod and a drill bit.

The invention further extends to a method of breaking rock which includes the steps of:

a) drilling a hole in the rock using a drill rod;

b) leaving the drill rod in the hole;

c) using water flow to direct a propellant charge into the hole through a passage in the drill rod; and d) at a leading end of the drill rod, firing the propellant charge with, at least, the drill rod and water in the hole and passage providing a stemming function.

The invention further extends to a rock drill which includes a drill rod, a drill bit attached to the drill rod, a cartridge feed line connected to a passage which extends through the drill rod to the drill bit, a cartridge magazine for loading a propellant cartridge into the feed line and a source of pressurized water for directing the cartridge along the passage.

The rock drill may include an initiating device for firing the propellant at or near the drill bit.

The cartridge may include a primer cap which contacts the initiating device thereby to fire the propellant.

The drill bit may include at least one channel which extends from the passage towards a side of the drill bit. This directs a pressure wave, produced by firing the propellant, towards a blind end of a hole, drilled by the drill bit, thereby to initiate fracture of the rock.

The pressurized water may propel the cartridge from the passage at a speed which is sufficiently high so that the cartridge impacts a wall of the hole and, upon impact, is initiated.

The invention also provides a rock breaking cartridge which includes an enclosure which is made from a frangible material, a propellant charge inside the enclosure, a primer cap at a leading end of the enclosure, and a seal at a trailing end of the enclosure.

The seal may be provided by means of a seal member made from a suitable flexible material such as polystyrene, foam rubber or the like, or by means of a flexible enlarged skirt or flange at the trailing end of the enclosure, or in any other appropriate way.

The enclosure is, as noted, made from a frangible material. The material should be fairly brittle and of a type which will break into a large number of small parts upon initiation of the propellant. This feature will enable the fragments, if any, left after firing the propellant to be flushed through a passage in a drill rod or drill bit.

BRIEF DESCRIPTION OF THE DRAWINGS

The invention is further described by way of example with reference to the accompanying drawings in which.

DESCRIPTION OF PREFERRED EMBODIMENT

Figure 1:
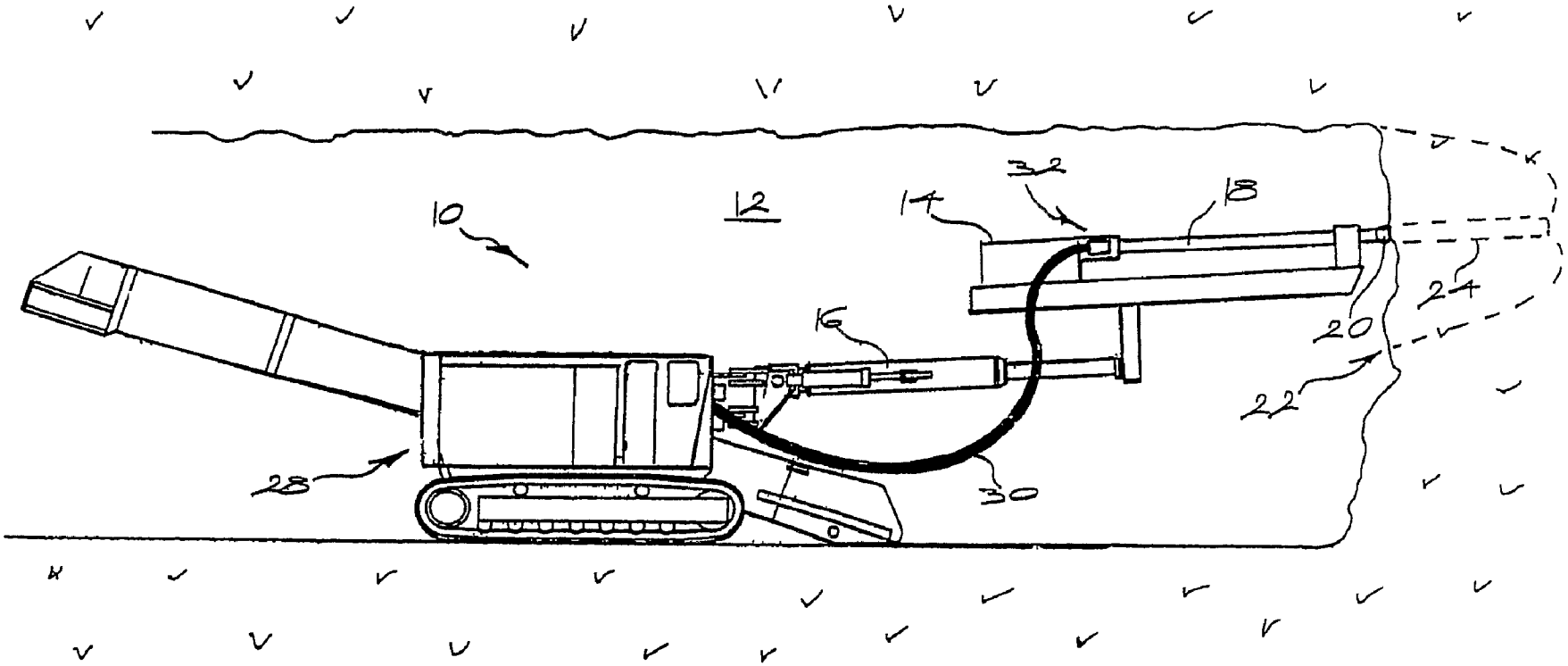
FIG. 1 illustrates a drilling machine, in an underground excavation, which makes use of the method of the invention.

FIG. 1 of the accompanying drawings illustrates a drilling machine 10 in an underground excavation 12. A rock drill 14 on a suitable mounting assembly 16 is mounted to the machine 10. The components 10, 14 and 16 are substantially conventional and therefore are not described in detail hereinafter.

A drill rod 18 is mounted to the rock drill and carries a drill bit 20 at its leading end.

The arrangement is used to drill holes into a rock face 22. FIG. 1 illustrates a single hole 24.

The drilling machine has a cabin or operator platform 28. A cartridge feed line 30 extends from a suitable location on the platform to a cartridge magazine 32 which is mounted to the rock drill 14.

Figure 2:
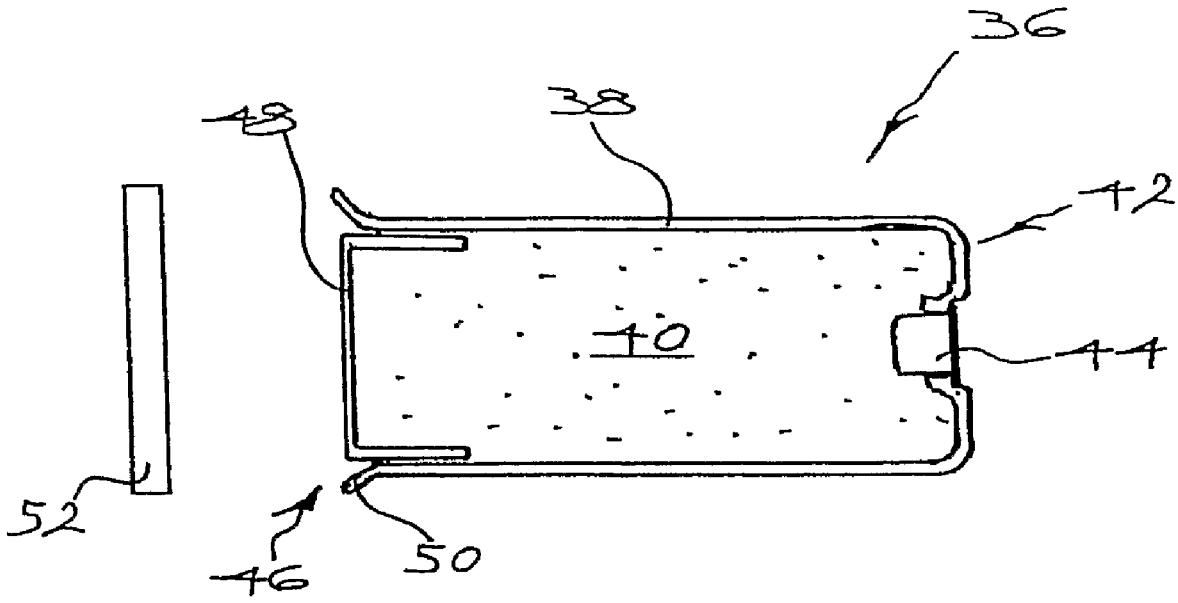
FIG. 2 shows one possible form of construction of a cartridge for use in the method of the invention.

FIG. 2 illustrates, in cross section, one form of construction of a cartridge 36 for use in the rock breaking method of the invention. The cartridge includes an enclosure 38 which is made from a brittle frangible material e.g. a hard plastics material and which contains a propellant charge 40. The charge is an energetic substance of a kind known in the art which, when initiated, produces high energy gas and vapour without an explosive effect.

The enclosure 38 has a leading end 42 and a primer cap 44 is centrally positioned at this end. At a trailing end 46 a cover 48 is engaged with the enclosure thereby to hold the propellant inside the enclosure in a water-tight manner. In this example of the invention the trailing end 46 is flared radially outwardly, thereby to provide a seal 50 which is integral with the enclosure 38 and which acts on a surrounding surface, as is described hereinafter. As an alternative to the seal 50, or in addition thereto, a circular disc 52 made from a suitable resilient material such as foam rubber or polystyrene or the like can be engaged with the cover 48 at the trailing end thereby to form a seal for the cartridge as it is passed through the feed line, as is described hereinafter.

Figure 3:
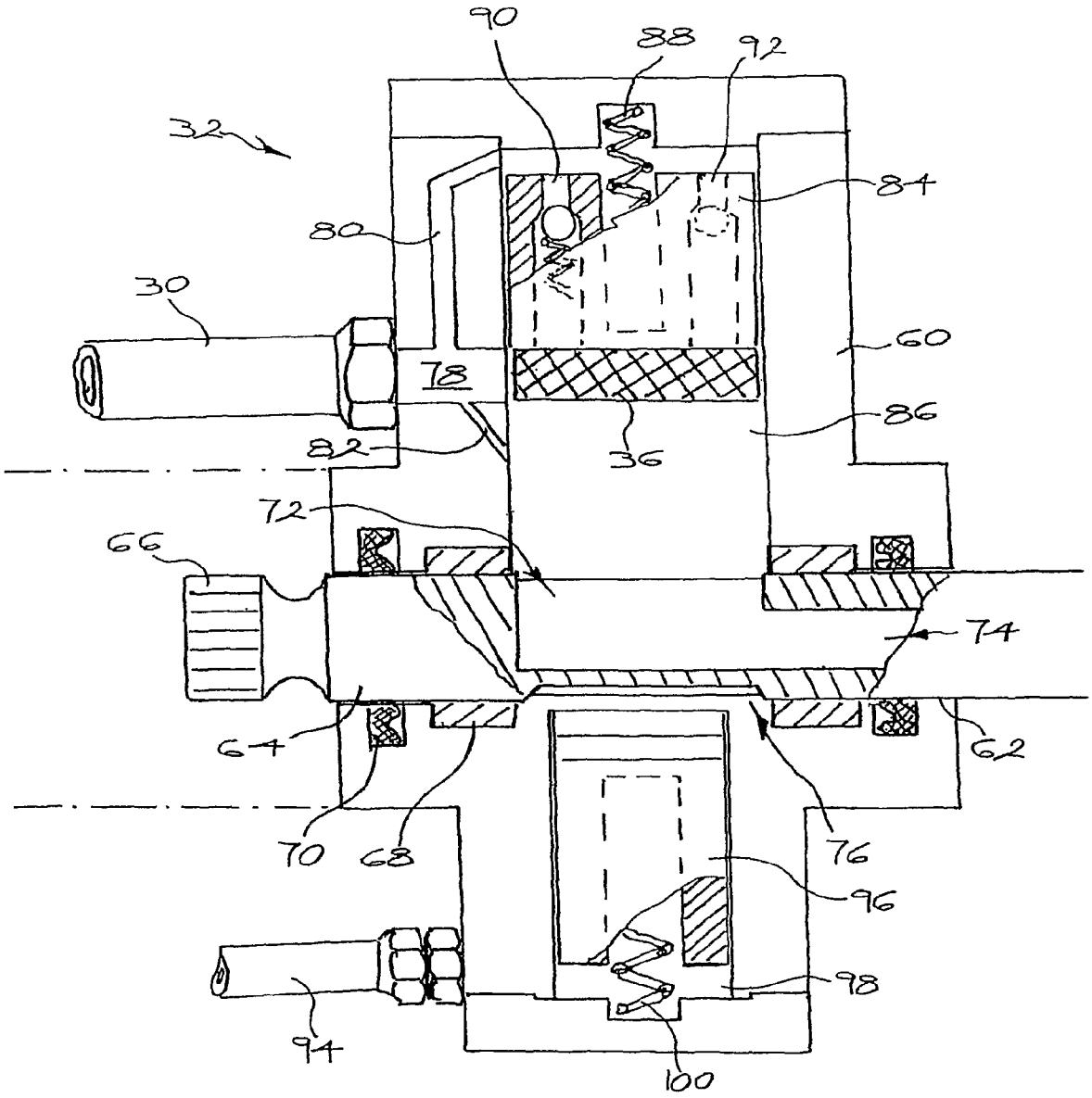
FIG. 3 is an enlarged view in cross section illustrating the construction of a shank lock and cartridge magazine used in the method of the invention.

FIG. 3 shows the magazine 32 in cross section. The magazine includes a housing 60 through which extends a bore 62 in which is located a drill shank 64 provided with a conventional spline formation 66 which is engageable with the rock drill 14 in a known manner. The drill shank 64 is supported on bearings 68 and is protected by means of seals 70.

The shank 64, on one side, is formed with an opening 72 which goes to a centrally located passage 74 and, on its outer side, opposing the opening 72, with a shallow slot or flat formation 76.

The feed line 30, which is connected to the housing 60, is in communication with a large passage 78 and two branches passage 80 and 82 respectively. A piston 84 is mounted for reciprocating movement inside a bore 86. A spring 88 acts between the housing and the piston. The piston carries two spring-loaded non-return valves 90 and 92 respectively.

An auxiliary water feed line 94 is connected to the housing 60 to control the operation of a piston 96 inside a bore 98, which substantially opposes the bore 86. A spring 100 acts between the piston 96 and the housing.

Figure 4:
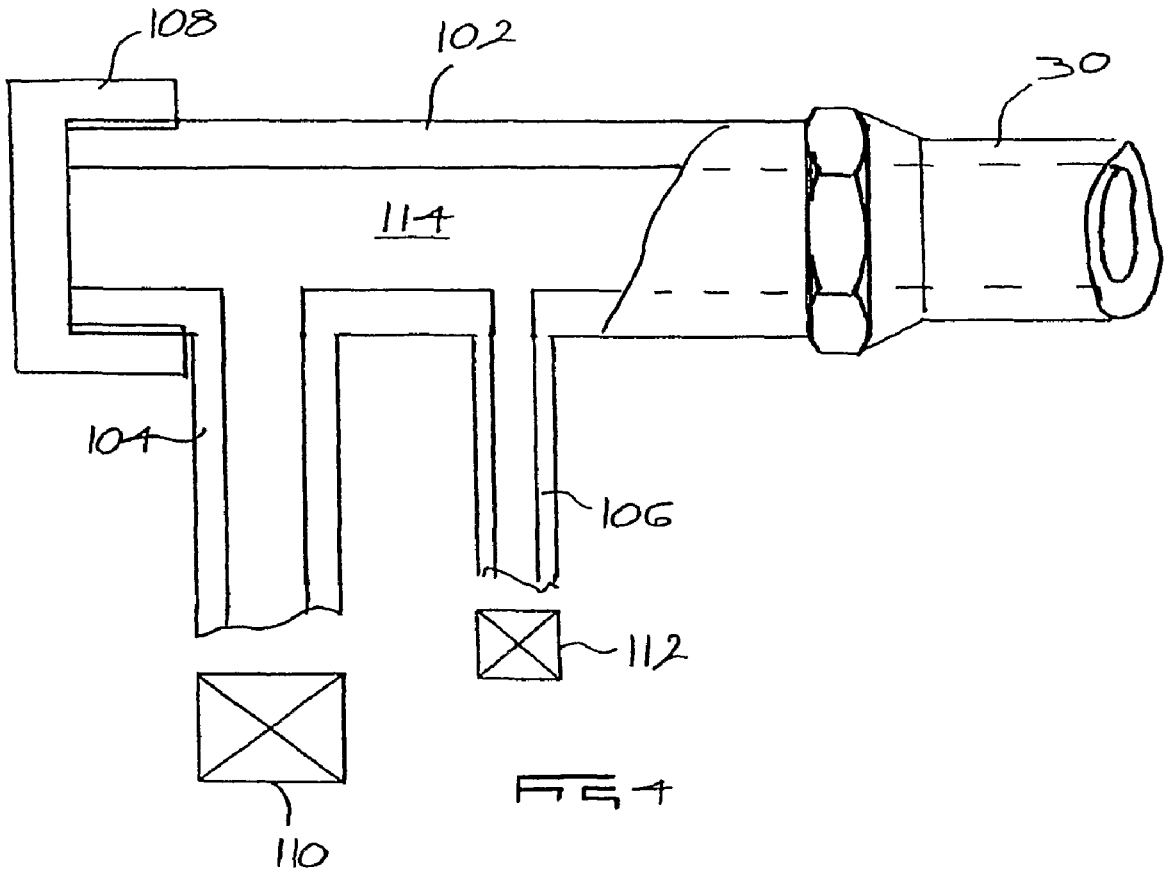
FIG. 4 shows in cross section the construction of a cartridge feed line arrangement.

At the platform 28 in the drilling machine 10 the feed line 30 terminates in a feed box 102 (shown in FIG. 4) which is connected to a high pressure high flow water line 104, a limited pressure and limited flow water line 106, and a locking device 108.

Control valves 110 and 112 are provided in the lines 104 and 106 respectively to control water flow through the lines into a central bore 114 in the feed box. The valves 110 and 112 are positioned at a location in the cabin of the drilling machine which is readily accessible by an operator.

Figure 5:
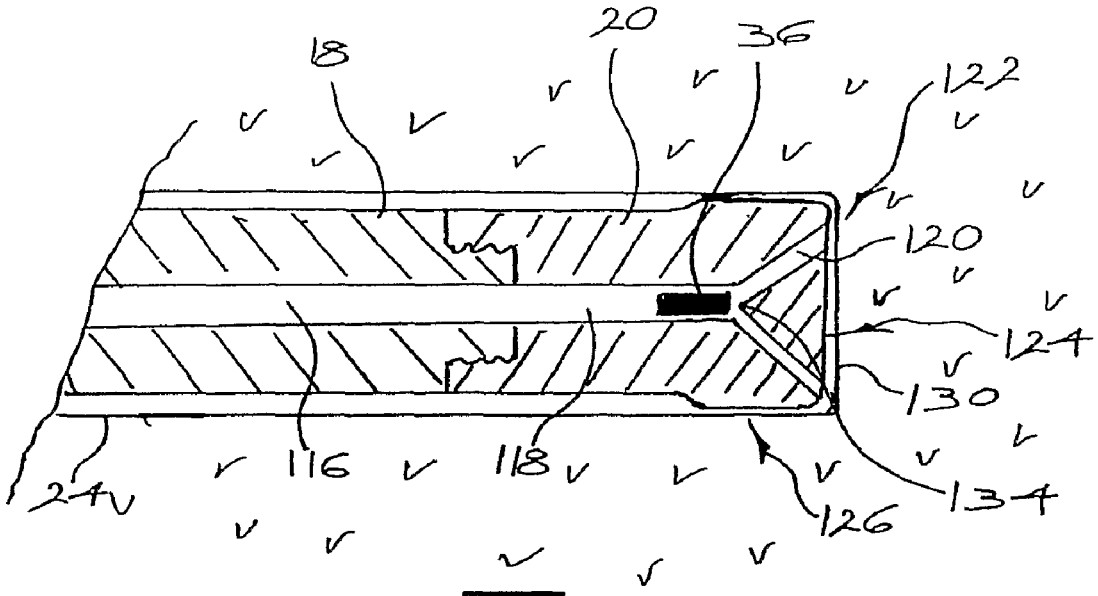
FIGS. 5 and 6 illustrate variations of a drill bit arrangement for use in the invention.

FIG. 5 illustrates a drill bit 20 attached to a leading end of a drill rod 18, on an enlarged scale. A passage 116 extends centrally through the drill rod and is in communication with a passage 118 in the drill bit. The drill bit passage diverges into two or three inclined flow channels 120 which radiate radially from the passage 118 towards extremities 122 of the drill bit substantially at a junction of a leading end 124 of the drill bit and its side 126.

In the implementation of the method of the invention an operator, in control of the drilling machine, drills a hole 24 into the rock face. The hole can be drilled to a suitable depth, for example between 1200 mm and 1500 mm, and has an appropriate diameter e.g. about 100 mm. The drill rod 18 is left in the hole and the drill bit 20 is positioned adjacent a blind end 130 of the hole as is shown in FIG. 5.

The operator then takes a propellant cartridge 36, of the type shown in FIG. 2, and loads the cartridge into the feed line 30. This is done by removing the locking device 108 from the feed box and placing the cartridge into the central bore 114. The cartridge is fed through the cartridge magazine along the feed line 30 by means of a flexible push rod or simply by closing the locking device and allowing limited flow of water, at a low pressure, through the line 106, under the control of the valve 112. It is possible however to automate this process.

The drill shank 64 shown in FIG. 3 is rotated slowly, to bring the slot 76 into alignment with the piston 96. At this point water is introduced into the bore 98, through the pipe 94, and the piston 96 is moved into engagement with the slot 76 on the drill shank. The spring 100 is used to pull the piston back after the activating water pressure is released.

The cartridge 36 moves, under water pressure, from the discharge end of the feed line 30 through the passage 78 and into the bore 86. The cartridge initially blocks or heavily restricts water flow from the passage 78 into the bore. However the branch passages 80 and 82 are open and a small quantity of water flows through these passages. The spring 88 initially keeps the piston 84 in the position shown in FIG. 3.

The operator then increases the water flow. The passage 82 is small and is capable of restricted water flow only. However the water pressure is applied via the branch passage 80 to an upper end of the piston 84 which then moves inside the bore 86 towards the drill shank 64 and the cartridge is moved by the piston towards the opening 72.

Once the piston passes the discharge end of the passage 78 the main water flow increases. The two spring-loaded non-return valves 90 and 92 let the water flow into the drill shank and the cartridge, which now is in the passage 74, is then propelled along the drill rod 18.

The non-return valves 90 and 92 prevent water flow in a reverse direction. The spring 86 pulls the piston back after the cartridge has been detonated and after the water flow has been turned off (as is described hereinafter).

The water flow rate through the drill rod 18 is fairly high and the propellant cartridge is accelerated along the passage 116 to at least 3 m/s. As is shown in FIG. 5 the cartridge 36 ultimately reaches a point inside the drill bit 20 which is formed with an initiating or firing device or formation 134. This is positioned so that when the cartridge reaches the formation 134 the primer cap 44, at the leading end 42 of the cartridge, is brought into sharp contact with the formation. The formation 134 may for example be formed by the junction of the flow channels 120.

As the primer hits the firing pin the propellant 40 inside the enclosure 38 is ignited. The water inside the passage 116 and between opposing surfaces of the drill rod and the hole 24 provides good stemming for the cartridge.

The high pressure water needed to accelerate the cartridge down the passage is provided in any suitable way but preferably is derived from an accumulator. Depending on the accumulator size the pressure behind the propellant cartridge may be in the range of 10 mPa. The detonation pressure takes only about 10 ms to build-up to 400 mPa. Effectively a high speed water slug is passed through the passage 116 in the drill rod. This water cannot stop and flow in the reverse direction as the pressure builds up to the highest detonation peak. The sudden, extremely high pressure pulse from the detonating cartridge, which is directed into the water, acts in all directions. The high pressure pulse is propagated through the drill bit to the front of the drill bit, around the drill bit and along the external surface of the drill rod. The detonation of the cartridge causes a recoil impact as well as a recoil force. The impact shock relates to the burning speed of the propellant powder while the recoil force relates to the amount of propellant powder in the cartridge as well as the quality of the rock.

Figure 6:
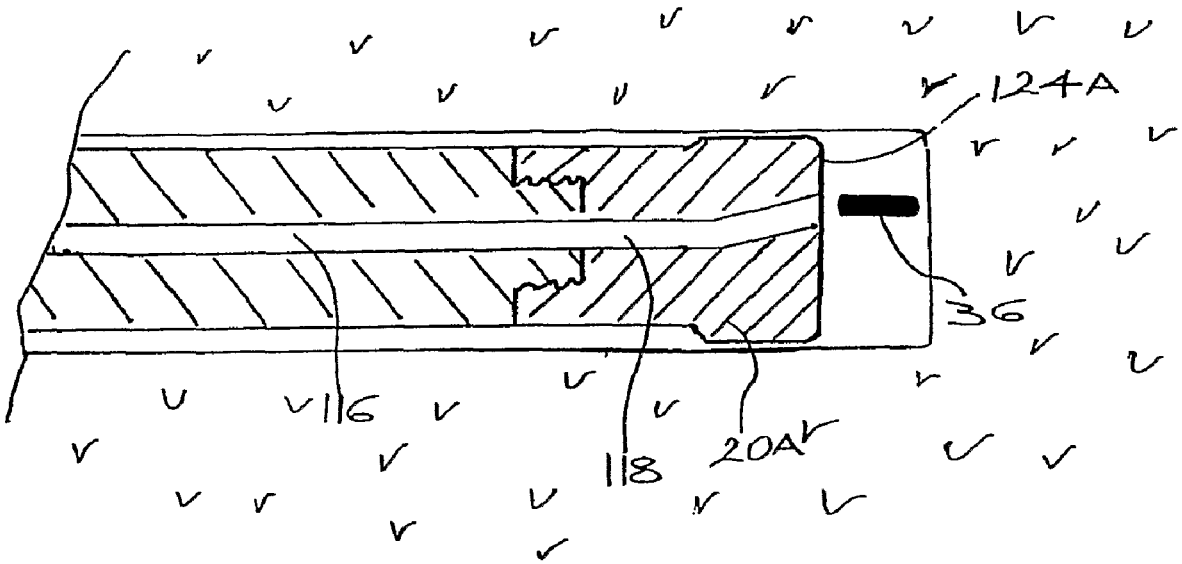

FIG. 6 shows a slightly different form of the invention. The drill bit 20A is formed with a passage 118A which extends through the drill bit to its leading end 124A. A cartridge 36, which is accelerated through the passage 116, is therefore able to leave the drill bit and enter a volume 136 between the leading end 124A and a blind end 130 of the hole. The cartridge 36 can be ignited, for example by using a high pressure water pulse, to produce high energy material which fractures the rock. The water in the hole 24 and around and inside the drill rod, as before, provides an effective stemming action which helps to optimise the effects of the fired propellant.

The mass of the drill bit, drill rod, drill shank, rock drill, drill feed and the drilling boom structure cushion the recoil force.

Typically the rock drill which is suited for use in this type of application is hydraulically operated. Use is made of a reciprocating piston for impacting the drill steel during drilling. Hydraulic oil lines on the drill are connected to nitrogen charged accumulators for cushioning pressure peaks caused by the reciprocating action. The percussive action is controlled by a valve arrangement on the rock drill.

The piston and the accumulators can be used as an additional cushion for the recoil force. A controlling valve can be kept open so that pressure in the oil lines will push the piston against the drill shank. The recoil force will then force the piston to reverse and oil from behind the piston will flow to the oil lines and the accumulators.

The propellant cartridge 36 should preferably be made to a standard size but can be loaded with different amounts of propellant according to requirement. For example 100 g of propellant will be enough for very heavy shots and smaller quantities, e.g. 50 g or 75 g, for smaller shots.

As noted the material for the cartridge enclosure should be brittle so that the material will break into small fragments upon detonation. After detonation, upon drilling a second hole the water will flush the debris from the hole.

It is possible to fire the primer cap in the manner described i.e. by means of a mechanical action when the cartridge reaches the drill bit. Alternatively the primer cap can be a pressure sensitive device which can be activated with a high pressure pulse generated in the feed water. This however is a less preferred approach.

The cartridge can automatically be ejected directly from a straight passage 116 so that a leading end of the cartridge, which carries the primer, is caused to impact a wall of the hole 24. This force is sufficiently high to initiate the primer and so fire the cartridge.

With this form of the invention a small impact transferring device may optionally be attached to the leading end of the cartridge. This device impacts the wall of the hole and transfers the impact force to the primer which is thereby initiated to fire the energetic substance in the cartridge.

Another possibility is to mount the primer to the cartridge, e.g on a side or rear of a housing of the cartridge, in such a way that the cartridge protrudes from the drill bit as the primer is brought into contact with a portion of the drill bit which initiates the primer.

Clearly before the cartridge can be fired while it is wholly inside the drill rod/drill bit, when it is wholly outside the drill rod/drill bit, or when it is partly inside, and partly outside, the drill rod/drill bit.

In the method of the invention the water is used for feeding the propellant cartridge into the hole and for providing a highly effective stemming action. By using high pressure water and performing the breaking process fast, the cracks in the rock are filled prior to detonation. Consequently the high pressure gases which are released from the detonation do not blow out but instead the detonation pressure peak is transferred into the cracks to enhance the rock-breaking effect.

The water in the blast does not constitute a safety hazard. The quantity of water in the hole during the blast is very small and after the blast, when the pressure from the detonation drops, from about 400 mPa to atmospheric pressure, the water substantially instantaneously vaporises.

It is evident that the rock breaking power of the cartridge is very efficiently utilised in that the detonation is stemmed with water and with the drill rod, backed by the rock drill, in the hole. It is preferred to use the drill rod in the manner described but a substantially similar effect can be achieved, to what has been described, by removing the drill rod from the hole 24 and then loading a cartridge into the hole using a custom-made pipe (not shown). This approach however is more tedious and time-consuming.

The rock breaking takes place immediately after the hole 24 has been drilled. Thus drilling and breaking are, for all practical purposes, a continuous process.

The rock breaking system is safe and environmentally friendly for the propellant blast does not create toxic gasses and does not need specific ventilation arrangements. The water which is used in the process explodes into vapour and helps to suppress dust.

The invention claimed is:

1. A drilling machine, comprising:

a hydraulically operated rock drill, a cartridge magazine which includes a housing mounted to the rock drill, a drill shank which is mounted to the housing and which has a formation which is engaged with the rock drill, a drill rod, a drill bit attached to the drill rod, the drill shank, drill rod and drill bit having respective passages in communication with one another, an opening, in a side of the drill shank, to the passage in the drill shank, a device for feeding a propellant cartridge, in the housing, through the opening into the passage in the drill shank, and a pressurized source for directing the propellant cartridge along the passages to the drill bit.

2. A drilling machine according to claim 1 which includes an initiating device for firing the propellant cartridge at or near the drill bit.

3. A drilling machine according to claim 1 wherein the drill rod is connected to the drill shank.

4. A drilling machine according to claim 2 which includes a feed box and at least one propellant cartridge in the feed box, the cartridge being brought into contact with the initiating device by the pressurized source thereby to fire the propellant cartridge.

5. A drilling machine according to claim 3 wherein the propellant cartridge includes an enclosure which is made from a frangible material, a propellant charge inside the enclosure, a firing device which is located at a leading end of the enclosure and a seal.

6. A drilling machine according to claim 5 wherein the seat is at a trailing end of the enclosure.

7. A drilling machine according to claim 5 wherein the firing device is a primer.

8. A drilling machine according to claim 1 wherein the drill bit includes at least one channel which extends from the passage in the drill bit towards an outer side of the drill bit.

9. A drilling machine according to claim 1 wherein the feeding device includes a piston for moving the propellant cartridge in the housing and through the opening into the passage in the drill shank.

10. A drilling machine according to claim 1 which includes a feed box from which the propellant cartridge is directed to the opening in the drill shank.

11. A drilling machine according to claim 1 which includes a mechanism for aligning the drill shank with the opening in the drill shank positioned to receive the propellant cartridge.

* * * * *